US010624440B1

(12) United States Patent
Jones

(10) Patent No.: US 10,624,440 B1
(45) Date of Patent: Apr. 21, 2020

(54) HARNESS FOR SPORTING OPTIC

(71) Applicant: Darren Jones, American Fork, UT (US)

(72) Inventor: Darren Jones, American Fork, UT (US)

( * ) Notice: Subject to any disclaimer, the term of this patent is extended or adjusted under 35 U.S.C. 154(b) by 0 days.

(21) Appl. No.: 16/031,606

(22) Filed: Jul. 10, 2018

Related U.S. Application Data

(60) Provisional application No. 62/530,797, filed on Jul. 10, 2017.

(51) Int. Cl.
*A45F 5/00* (2006.01)

(52) U.S. Cl.
CPC ..... *A45F 5/00* (2013.01); *A45F 2005/006* (2013.01)

(58) Field of Classification Search
CPC ..... A45F 5/00; A45F 3/14; A45F 2003/007; A45F 2005/006; Y10S 224/909
See application file for complete search history.

(56) References Cited

U.S. PATENT DOCUMENTS

| | | | | |
|---|---|---|---|---|
| 5,016,797 | A * | 5/1991 | Rowledge | A45F 5/00 224/257 |
| 5,320,261 | A * | 6/1994 | Andersen | A45C 11/08 224/194 |
| 2003/0127479 | A1* | 7/2003 | Giggleman | A45F 3/14 224/260 |
| 2004/0140335 | A1* | 7/2004 | Hancock | A45F 3/14 224/637 |
| 2004/0178239 | A1* | 9/2004 | Hancock | A45F 3/14 224/258 |
| 2004/0206792 | A1* | 10/2004 | Mineer | A45C 11/38 224/259 |
| 2014/0158726 | A1* | 6/2014 | Malara | A45F 5/00 224/264 |
| 2014/0367438 | A1* | 12/2014 | Hunt | A45F 5/14 224/567 |

* cited by examiner

*Primary Examiner* — Corey N Skurdal
(74) *Attorney, Agent, or Firm* — Thorpe North & Western, LLP; David W. Osborne

(57) ABSTRACT

A harness for a sporting optic can be donned by a user to secure the sporting optic to the person or torso of the user. The harness provides a secured position for the sporting optic to resist swinging, and thus damage and interference, of the sporting optic. The harness has shoulder straps and a torso strap. A restraining pad can be carried by the torso strap. The sporting optic can be tucked behind the restraining pad.

12 Claims, 6 Drawing Sheets

HARNESS FOR SPORTING OPTIC

PRIORITY DATA

This application claims the benefit of U.S. Provisional Patent Application Ser. No. 62/530,797, filed Jul. 10, 2017, which is incorporated herein by reference.

BACKGROUND

Sporting optics, such as binoculars, are often used during sporting activities, such as hunting. Straps are often used to retain the sporting optic around a user's neck while the user manipulates another object, such as a rifle. The sporting object can swing from the user's neck, such as when moving or leaning over, interfering with the activity and/or damaging the sporting optic.

SUMMARY

A harness for a sporting optic, such as binoculars, can be donned by a user to secure the sporting optic to the person or torso of the user, and providing a secured position for the sporting optic to resist swinging, and thus damage and interference, of the sporting optic. The harness can position the sporting optic for ready use at the torso of the user, while allowing the sporting optic to be raised for use. The harness has shoulder straps and a torso strap. A flexible shell or a restraining pad is carried by the torso strap. The sporting optic is coupled to the shoulder straps, and can be raised to eye lever for viewing, and lowered to torso level when not in use. When the sporting optic is lowered, the sporting optic can be tucked behind the flexible shell or the restraining pad on the torso strap to hold the sporting optic taut between the torso and the flexible shell or the restraining pad. Thus, the sporting optic is restrained from swinging, and potential damage and interference. In addition, the sporting optic can be inserted within the flexible shell for further protection from the elements.

In addition, a cover for a sporting optic includes a flexible fabric shell having an interior surface defining an interior cavity and an exterior surface opposite the interior surface. The flexible fabric shell can be adapted for placement of the sporting optic within the interior cavity via an expandable and contractible opening in the flexible fabric shell. The flexible shell can be secured to the harness, as described above. In addition, the flexible shell can be removed from the harness. A strap and buckle can extend across the opening the shell to enclose, or more enclose, the sporting optic in the shell. An area of the interior surface of the flexible fabric shell can minimize or eliminate scratching of the eyepieces and/or objective lenses of the sporting optic.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1A:
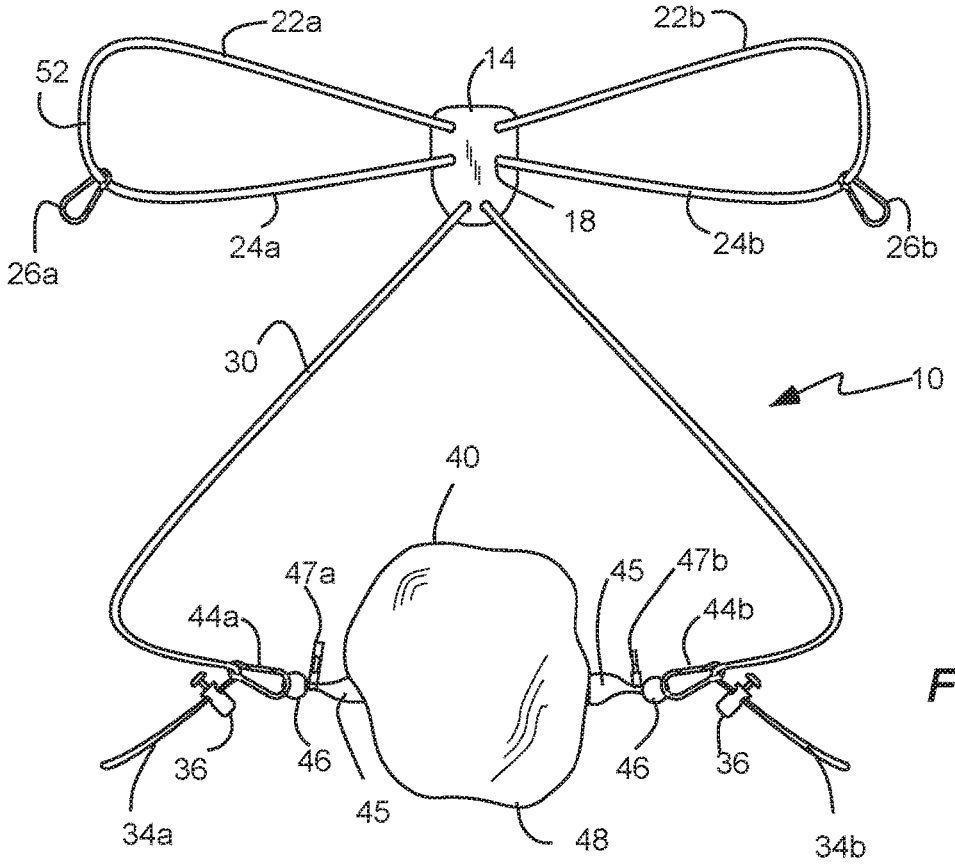
FIG. 1*a* is a front view of a harness for a sporting optic in accordance with an embodiment of the invention.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

The singular forms "a," "an," and "the" include plural referents unless the context clearly dictates otherwise. Thus, for example, reference to "a particle" includes reference to one or more of such materials and reference to "subjecting" refers to one or more such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term, like "comprising" or "including," it is understood that direct support should be afforded also to "consisting essentially of" language as well as "consisting of" language as if stated explicitly and vice versa.

The term "sporting optic" is used herein to refer to optics used for magnification of distal or far-field objects, thus enlarging the object to view or bringing the object into closer view, or clarification of object, or even different visualization of objects, including by way of example, a binocular, a field-glass, a monocular, a telescope, a spotting scope, a scope, a rifle scope, a night vision optic, a range finder, a thermal viewer, a sight, a camera, etc. Such optics are typically utilized outdoors and for various activities, such as hunting, shooting, target shooting, archery, bird or nature watching, etc. In addition, such optics can be typically suspended or hung around a user's neck.

Harness for Sporting Optic

An initial overview of technology embodiments is provided below and specific technology embodiments are then described in further detail. This initial summary is intended to aid readers in understanding the technology more quickly, but is not intended to identify key or essential features of the technology, nor is it intended to limit the scope of the claimed subject matter.

A harness for a sporting optic, such as binoculars, can be donned by a user to secure the sporting optic to the person or torso of the user, and providing a secured position for the sporting optic to resist swinging, and thus damage and interference, of the sporting optic. The harness can position the sporting optic for ready use at the torso of the user, while allowing the sporting optic to be raised for use. When the sporting optic is lowered, the harness can provide a flexible shell or a restraining pad on a torso strap to hold the sporting optic taut between the torso and the flexible shell or the restraining pad. Thus, the sporting optic is restrained from swinging, and potential damage and interference.

In addition, a cover for the sporting optic can include a flexible fabric shell having an interior surface defining an interior cavity and an exterior surface opposite the interior surface. The flexible fabric shell can be adapted for placement of sporting optic within the interior cavity via an expandable and contractible opening in the flexible fabric shell. The flexible shell can be secured to the harness, as described above. In addition, the flexible shell can be removed from the harness. A strap and buckle can extend across the opening the shell to enclose, or more enclose, the sporting optic in the shell, and/or to secure the flexible fabric shell to the sporting optic. An area of the interior surface of the flexible fabric shell can minimize or eliminate scratching of the objective lenses of the sporting optic.

FIG. 1*a* depicts the front view of an embodiment of a harness 10 for securing the sporting optic. The harness 10 has a back plate 14 that can be formed of leather or fabric, and can be relatively rigid. The harness 10 can have a plurality of holes 18. A pair of shoulder straps, such as left and right shoulder straps 22*a* and 22*b*, extend from the back plate 14. The shoulder straps 22*a* and 22*b* can be coupled to the back plate 14 utilizing the holes 18. In one aspect, the shoulder straps 22*a* and 22*b* can be formed of elastic cord, and can be relatively flexible with respect to the back plate. The shoulder straps 22*a* and 22*b* form a pair of shoulder loops, such as left and right shoulder straps 24*a* and 24*b*, respectively. A pair of couplers, such as left and right couplers 26*a* and 26*b*, is carried by the pair of shoulder straps 22*a* and 22*b*, respectively. The pair of couplers 26*a* and 26*b* can be any type of coupler, such as clips, hooks, etc.

A torso strap 30 extends from the back plate 14. The torso strap 30 can be coupled to the back plate 14 utilizing the holes 18. In one aspect, the torso strap 30 can be formed by elastic cord, and can be relatively flexible. The torso strap 30 can form a torso loop. The torso strap 30 can have distal free ends 34*a* and 34*b*. In one aspect, one or both distal free ends 34*a* and 34*b* can an adjustable fastener, such as a spring-loaded cord lock 36, capable of selectively receiving the distal free ends of the torso strap therethrough to vary an effective length of the torso strap. In another aspect, a pair of couplers, such as pair of couplers/carabiners/clips 44*a* and 44*b* can be disposed on the distal free ends 34*a* and 34*b* of the torso strap 30. The cord locks 36 can abut to the couplers/carabiners/clips 44*a* and 44*b* on the distal free ends. Thus, the torso strap can be cinched or drawn taut, and the cord locks 36 can maintain a length of the torso strap.

A flexible shell 40 is coupled to the torso strap 30. In one aspect, the flexible shell 40 can be coupled to and between the distal free ends 34*a* and 34*b* of the torso strap 30. A pair of tabs 45 can be coupled to opposite sides of the flexible shell 40, such as at opposite sides of an opening (52 FIG. 1*b*) of the flexible shell. A pair of rings 46 can be coupled to the pair of tabs. The pair of couplers/carabiners/clips 44*a* and 44*b* can be releasably coupled to the pair of rings 46 to removably couple the flexible shell 40 to and between the distal free ends 34*a* and 34*b* of the torso strap 30. In addition, a buckle coupled between the pair of tabs 45 with a first buckle portion 47*a* coupled to one of the pair of tabs 45 and a second buckle portion 47*b* coupled to the other of the pair of tabs 45. The flexible shell 40 can have an outer surface 48. Indicia can be disposed on the outer surface 48 of the flexible shell 40. In one aspect, the indicia can be indicative of a surrounding environment, such as camo or camouflage. In another aspect, the indicia can be or can comprise a high visibility warning, such as hunter orange. In another aspect, the outer surface 48 can include a protective coating such as water-proofing.

Figure 1B:
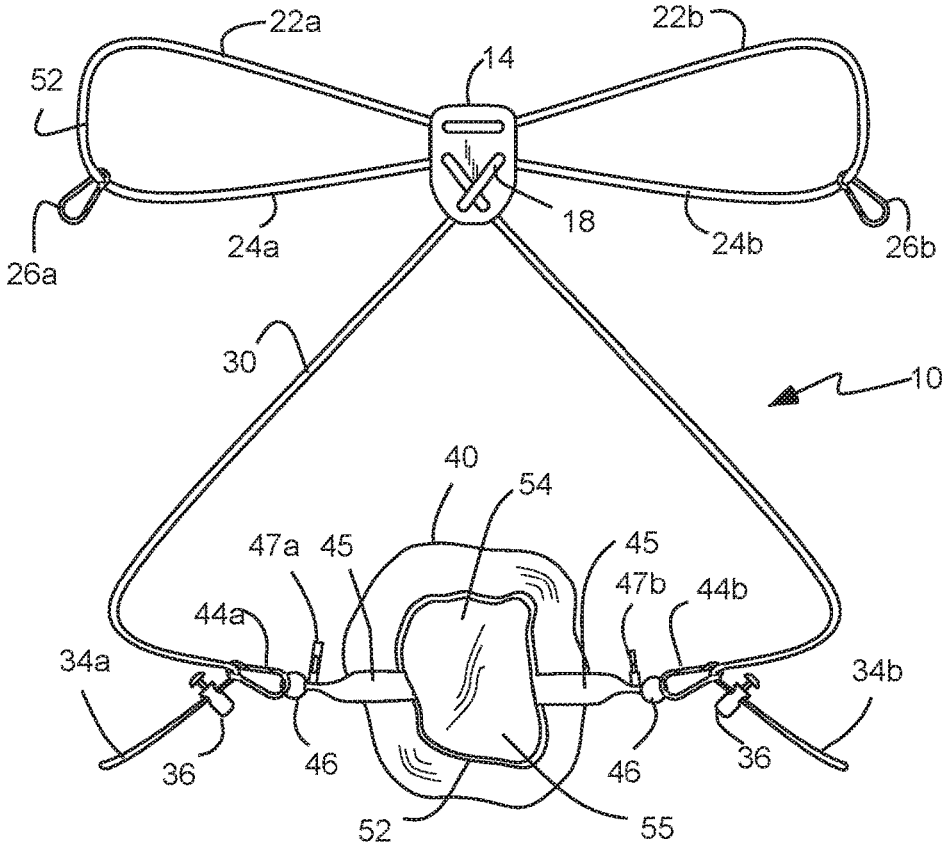
FIG. 1*b* is a rear view of the harness of FIG. 1*a*.

FIG. 1*b* depicts the rear view of the harness 10. In one aspect, the pair of shoulder straps 22*a* and 22*b* and the torso strap 30 can be formed by a single continuous strap 52. The single continuous strap 52 can be threaded through the holes 18 in the back plate 14 to form the shoulder loops 24*a* and 24*b* and the torso loop. In one aspect, the flexible shell 40 can have an opening 52 into the shell. In another aspect, the flexible shell 40 can have an inner surface 54 that can have a soft or plush surface to resist marring the optic. In one aspect, the flexible shell 40 can comprise several layers, or can be a laminate, with different layers to provide different functions, such as an outer water-proof layer, an inner plush layer, and/or an intermediate cushion layer or foam layer.

The flexible fabric shell can be made of a variety of materials. Typically, any soft, flexible material can be used. Non-limiting examples can include neoprene, neogreen, lycra, thermocline, rubber, polyester, polyamide, polyethylene, polypropylene, cotton, silk, wool, or combinations thereof.

The flexible fabric shell 40 can have an interior surface 54 defining an interior cavity 55 and an exterior surface 48 opposite the interior surface. The interior surface and the exterior surface can be made of the same material or different materials. In some examples, the interior surface can be made of, include, and/or be lined with a material that minimizes or eliminates scratching of the eyepieces, objective lenses, and/or other surfaces of the sporting optic. In other examples, at least a portion or an area of the interior surface can be made of, include, and/or be lined with a material that minimizes or eliminates scratching of the eyepieces, objective lenses, and/or other surfaces of the sporting optic. In some examples, the portion or area of the interior surface that is made of, includes, and/or is lined with the scratch-minimizing material can include an area that is intended or designed to interface with an eyepiece, an objective lens, and/or other scratch-sensitive surface of the sporting optic.

Generally, the scratch-minimizing material, or the material that minimizes or eliminates scratching, can include any soft, non-abrasive material. Non-limiting examples can include cotton, chamois, polyvinyl alcohol, polyester, polyethylene, polyamide, or a combination thereof. In some examples, the scratch-minimizing material can be a microfiber material. In some examples, the microfiber material can be made of polyester or a blend of polyester and polyamide. In some examples, the microfiber material can be a split microfiber material, such that all or a majority of the individual microfiber filaments are split into multi-stranded filaments.

In some examples, a tab, handle, or other gripping feature can be positioned on or coupled to the exterior surface of the flexible fabric shell opposite an area made of, including, and/or lined with the scratch-minimizing material. Thus, a user can grasp the tab or other gripping feature coupled to the exterior surface of the flexible fabric shell and manipulate the scratch-minimizing material disposed opposite the gripping feature to clean an eyepiece, an objective lens, etc. of the sporting optic. The tab, handle, or other gripping feature can also be made out of a variety of materials. Non-limiting examples can include, neoprene, neogreen, lycra, thermocline, rubber, polyester, polyamide, polyethylene, polypropylene, cotton, silk, wool, or a combination thereof.

Figure 5:
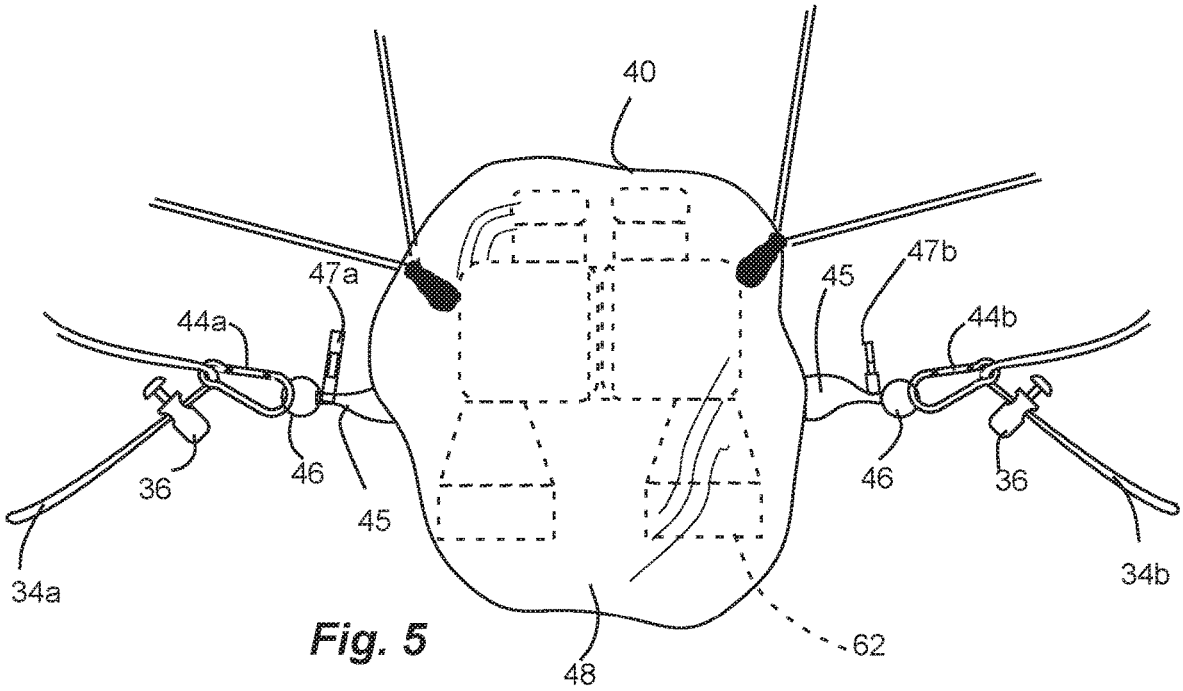
FIG. 5 is a front view of the harness of FIG. 1*a*, shown holding the sporting optic in a flexible shell.
Figure 6:
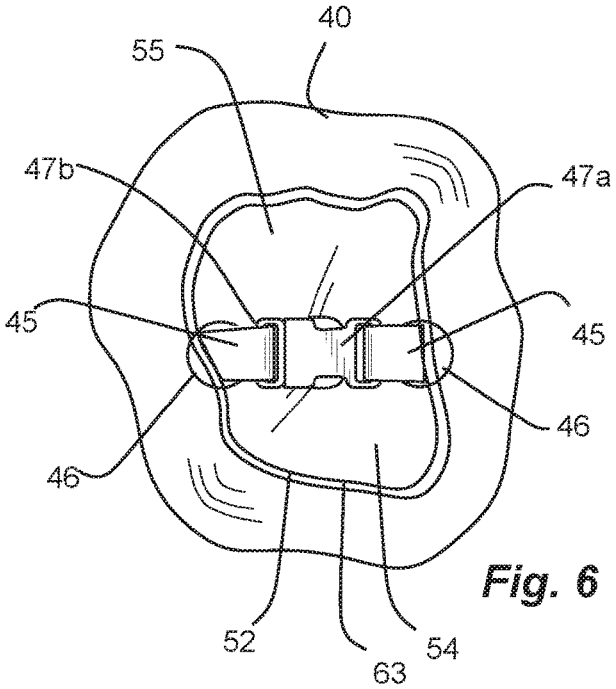
FIG. 6 is a rear view of the harness of FIG. 1*a*, shown with the flexible shell removed from the harness, and in a closed configuration.

FIGS. 5 and 6 depict front and rear views of the flexible shell 40, respectively. The flexible fabric shell 40 can be adapted for placement of the sporting optic 62, such as, within the interior cavity 54 via an expandable and contractible opening 52 in the flexible fabric shell. As there are many different sizes of sporting optics or binoculars, the flexible fabric shell can be made to accommodate a variety of sizes of binoculars. In some examples, the flexible fabric shell can be a universal shell that is adapted to accommodate all or most sizes of sporting optic or binoculars. In other examples, the flexible fabric shell can be made in a variety of sizes to accommodate different ranges of sporting optics or binocular sizes.

The flexible fabric shell can accommodate a plurality of sizes of sporting optics or binoculars for a number of reasons. For example, the flexible fabric shell can be made of a stretchable material. When the flexible fabric shell is made of a stretchable material, it can be stretched to cover larger sized sporting optics or binoculars, while being able to accommodate smaller sized binoculars without significant stretching. Further, whether the flexible fabric shell is stretchable or not, the flexible fabric shell can include an expandable and contractible opening, such as opening 52. Thus, the expandable and contractible opening 52 can be expanded to let out or contracted to draw in the flexible fabric material to adjust a volume of the interior cavity to a greater or lesser volume, as desired. The expandable and contractible opening can include a variety of features to facilitate expansion and/or contraction of the opening. Non-limiting examples can include an elastomeric band, a drawstring, a cinch, a strap, a zipper, or a combination thereof. In one aspect, the opening 52 can further comprise an elastic band 63 to expand the opening to receive the sporting optic, and contract the opening thereafter.

As discussed above, a tabs 45 can be coupled to the flexible fabric shell 40. The tabs 45 can be coupled at the opening 52 of the shell. The tabs 45 can be configured to secure the flexible fabric shell 40 to the sporting optic or binoculars. In one aspect, the tabs 45 can be oriented to cross the expandable and contractible opening 52 laterally, and fasten with the buckle 47*a* and 47*b*. In another aspect, the tabs can be oriented to cross the expandable and contractible opening longitudinally. In yet other examples, the tabs, or a pair of tabs, can be oriented to cross the expandable and contractible opening both laterally and longitudinally.

The tabs 45 can include two tabs. Each of the tabs 45 is attached to the flexible fabric shell 40 at opposite lateral sides of the expandable and contractible opening 52.

The tabs can be made of a variety of materials. Non-limiting examples can include leather, polyester, polyethylene, polypropylene, polyamide, ethylene vinyl acetate, rubber, neoprene, neogreen, lycra, thermocline, cotton, silk, wool, or a combination thereof.

A number of connecting features can be used to connect the tabs. While the example illustrated in FIGS. 5 and 6 is a buckle, the tabs can be connected via a buckle, a snap, a hook and loop fastener, a button, a magnet, the like, or a combination thereof. In some examples, the tabs does not include a connecting feature, but is coupled to the flexible fabric shell at substantially opposite sides of the expandable and contractible opening.

Figure 2A:
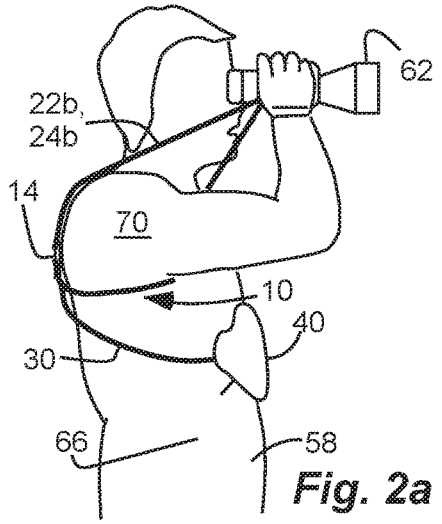
FIG. 2*a* is a schematic side view of the harness of FIG. 1*a*, shown donned by a user and holding the sporting optic at eye level.
Figure 2B:
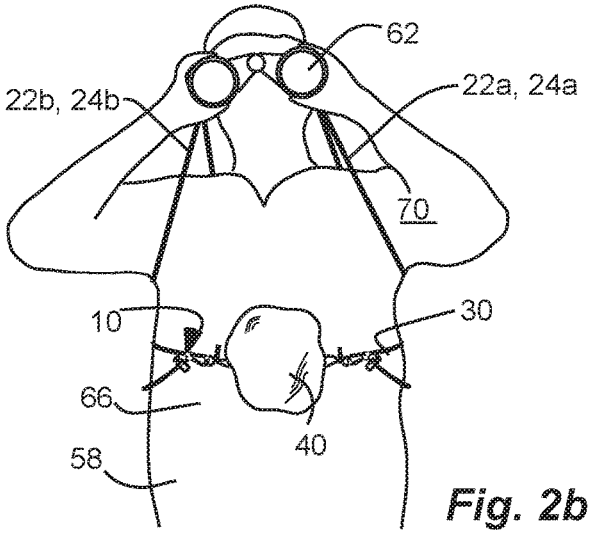
FIG. 2*b* is a schematic front view of the harness of FIG. 1*a*, shown donned by the user and holding the sporting optic at eye level.

FIG. 2*a* depicts a side view of the harness 10 donned by a user 58 and securing the sporting optic 62 held at eye level of the user. Similarly, FIG. 2*b* is a front view of the harness 10 donned by the user 58 and securing the sporting optic 62 held at eye level of the user. The back plate 14 of the harness 10 is disposed at a back of a torso 66 of the user 58. The pair of shoulder straps 22*a* and 22*b* extend from the back plate 14, forming the pair of shoulder loops 24*a* and 24*b* looping around shoulders 70 of the user 58. The pair of shoulder straps 22*a* and 22*b* is sized and/or constructed to allow the sporting optic 62 to be selectively raised to eye level with respect to the user. The torso strap 30 extends from the back plate 14 and wraps around the torso 66 of the user 58 below the pair of shoulder loops 24*a* and 24*b*. The torso strap 30 can be taut about the torso 66 of the user 58. In one aspect, the torso strap 30 is an adjustable belt forming an adjustable loop to wrap taut around the torso 66 of the user 58.

Figure 3A:
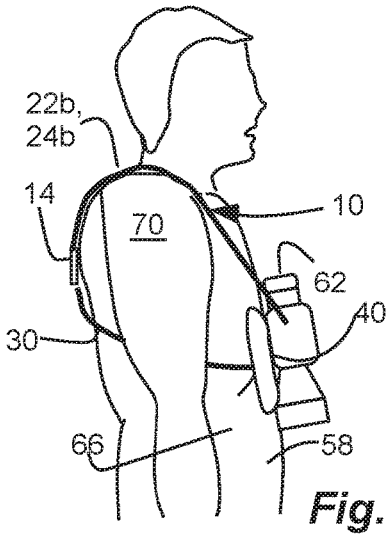
FIG. 3*a* is a schematic side view of the harness of FIG. 1*a*, shown donned by the user and holding the sporting optic at torso level.
Figure 3B:
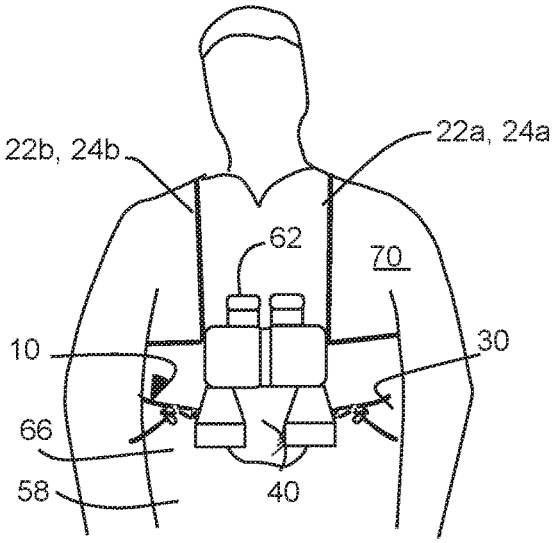
FIG. 3*b* is a schematic front view of the harness of FIG. 1*a*, shown donned by the user and holding the sporting optic at torso level.

FIG. 3*a* depicts a side view of the harness 10 donned by the user 58 and holding the sporting optic 62 at torso level. Similarly, FIG. 3*b* depicts a front view of the harness 10 donned by the user 58 and holding the sporting optic 72 at torso level. The pair of couplers 26*a* and 26*b* secure the sporting optic 62 pendent from the pair of shoulder straps 22*a* and 22*b*. The pair of couplers 26*a* and 26*b* is sized and/or constructed to allow the sporting optic 62 to be selectively lowered to the torso level with respect to the user 58. The restraining pad 40 is coupled to the torso strap 30 and abuts to the sporting optic 62 when the sporting optic is lowered to torso level.

Figure 4A:
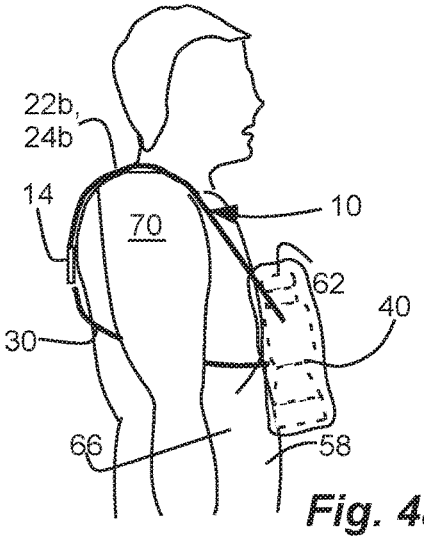
FIG. 4*a* is a schematic side view of the harness of FIG. 1*a*, shown donned by the user and holding the sporting optic at torso level and tucked behind a restraining pad.
Figure 4B:
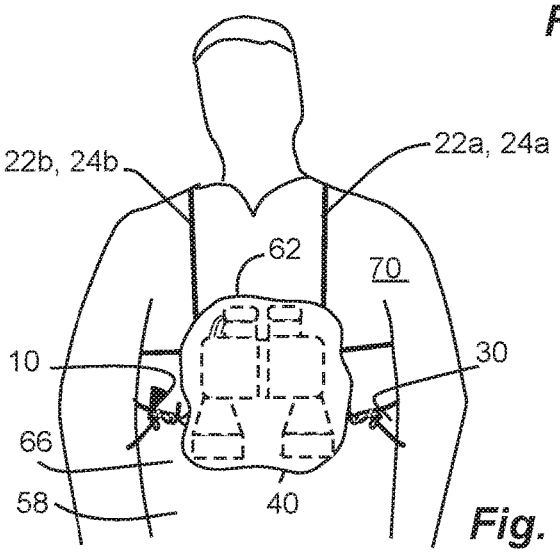
FIG. 4*b* is a schematic front view of the harness of FIG. 1*a*, shown donned by the user and holding the sporting optic at torso level and tucked behind a restraining pad.

FIG. 4*a* depicts a side view of the harness 10 donned by the user 58 and holding the sporting optic 62 at torso level and inserted within (or tucked behind) the flexible shell 40. Similarly, FIG. 4*b* depicts a front view of the harness 10 shown donned by the user 58 and holding the sporting optic 62 at torso level inserted within (or tucked behind) the flexible shell 40. The torso strap 30 is sized and positioned with respect to the pair of shoulder straps 22*a* and 22*b* to hold the sporting optic 62 taut against the torso 66 of the user 58 when the sporting optic is lowered to the torso level and inserted within (or tucked behind) the flexible shell 40.

A method for securing a sporting optic 62 to a user 58, and for using the harnesses 10 described above, comprises donning the harness 10, as shown in FIGS. 2*a*-4*b*. Donning the harness can comprise inserting arms through the shoulder straps 22*a* and 22*b*, and wrapping the torso strap 30 around the torso 66. The couplers 44*a* and 44*b* or buckles can be released and coupled to facilitate donning of the torso strap 30. In one aspect, the torso strap can be taut around the torso of the user due to the elasticity of the torso strap. In another aspect, the torso strap 30 can be adjusted using the cord lock 36.

The sporting optic 62 is secured to the harness 10 with the sporting optic 62 pendent from an upper torso of the user, as shown in FIGS. 3*a* and 3*b*. The sporting optic 62 is secured to the harness 10, or shoulder straps 22*a* and 22*b* thereof, by the pair of couplers 26*a* and 26*b*, as shown in FIGS. 3*a* and 3*b*.

The sporting optic 62 is selectively raised to eye level while the sporting optic 62 remains secured to the harness 10, as shown in FIGS. 2*a* and 2*b*. In addition, the sporting optic 62 is selectively lowered to torso level while the sporting optic 62 remains secured to the harness 10 and pendent from the upper torso of the user, as shown in FIGS. 3*a* and 3*b*.

The sporting optic 62 is selectively inserted within (or tucked behind) the flexible shell 40 of the torso strap 30, as shown in FIGS. 4*a* and 4*b*. The torso strap 30 is wrapped taut about the torso 66 of the user 58, and the sporting optic 62 is disposed within the flexible shell (or between the flexible shell 40 of the torso strap 30 and the torso of the user).

In one aspect, the method can further comprises selectively coupling and uncoupling the flexible shell 40 to the torso belt 30.

Figure 7A:
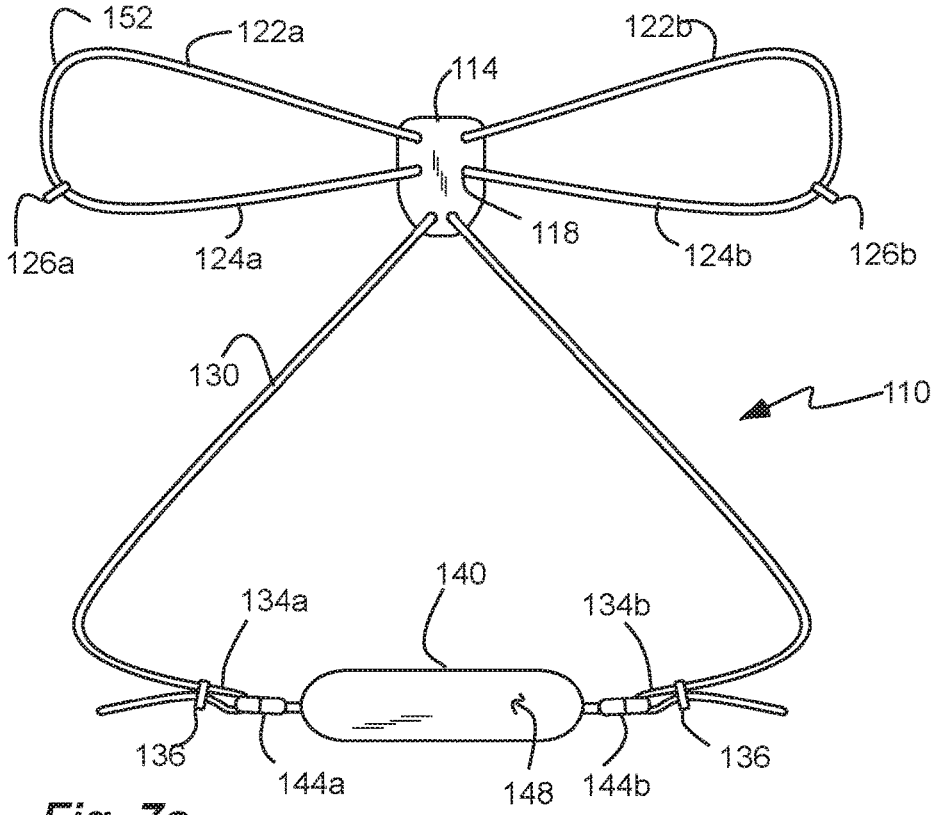
FIG. 7*a* is a front view of another harness for a sporting optic in accordance with another embodiment of the invention.

FIG. 7*a* depicts the front view of an embodiment of a harness 110 for securing the sporting optic. The harness 110 has a back plate 114 that can be formed of leather or fabric, and can be relatively rigid. The harness 110 can have a plurality of holes 118. A pair of shoulder straps, such as left and right shoulder straps 122*a* and 122*b*, extend from the back plate 114. The shoulder straps 122*a* and 122*b* can be coupled to the back plate 114 utilizing the holes 118. In one aspect, the shoulder straps 12*a* and 122*b* can be formed of elastic cord, and can be relatively flexible with respect to the back plate. The shoulder straps 122*a* and 122*b* form a pair of shoulder loops, such as left and right shoulder straps 124*a* and 124*b*, respectively. A pair of couplers, such as left and right couplers 126*a* and 126*b*, is carried by the pair of shoulder straps 122*a* and 122*b*, respectively. The pair of couplers 126*a* and 126*b* can be any type of coupler, such as clips, hooks, etc.

A torso strap 130 extends from the back plate 114. The torso strap 130 can be coupled to the back plate 114 utilizing the holes 118. In one aspect, the torso strap 130 can be formed by elastic cord, and can be relatively flexible. The torso strap 130 can form a torso loop. The torso strap 130 can have distal free ends 134*a* and 134*b*. In one aspect, the torso strap 130 can be an adjustable belt forming an adjustable loop. In one aspect, one or both distal free ends 134*a* and 134*b* can be looped back upon themselves, and through an adjustable fastener, such as a drawstring fastener 136. Thus, the torso strap can be cinched or drawn taut.

A restraining pad 140 is coupled to the torso strap 130. In one aspect, the restraining pad 140 can be coupled to and between the distal free ends 134*a* and 134*b* of the torso strap 130. A pair of couplers 144*a* and 144*b*, such as side release buckles, can be disposed between the distal free ends 134*a* and 134*b* of the torso strap 130 and the restraining pad 140, respectively, to selectively coupled and release the restraining pad 140 to the distal free ends 134*a* and 134*b* of the torso strap 130. In another aspect, the restraining pad 140 can be wider than the torso strap 130, in a vertical direction with respect to the torso of the user. Thus, the restraining pad 140 can provide a broader or larger surface area to bear against the optic. The restraining pad 140 can have an outer surface 148. Indicia can be disposed on the outer surface 148 of the restraining pad 140. In one aspect, the indicia can be indicative of a surrounding environment, such as camo or camouflage. In another aspect, the indicia can be or can comprise a high visibility warning, such as hunter orange. In another aspect, the outer surface 148 can include a protective coating such as water-proofing.

Figure 7B:
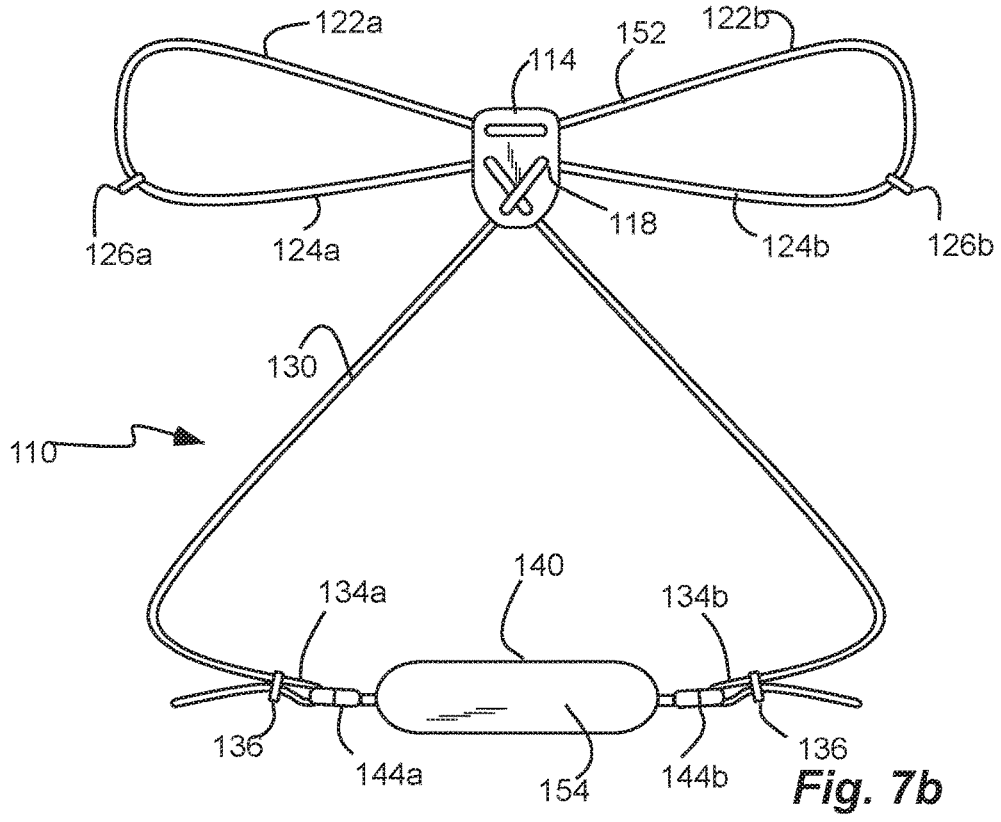
FIG. 7*b* is a rear view of the harness of FIG. 7*a*.

FIG. 7*b* depicts the rear view of the harness 110. In one aspect, the pair of shoulder straps 122*a* and 122*b* and the torso strap 130 can be formed by a single continuous strap 52. The single continuous strap 152 can be threaded through the holes 118 in the back plate 114 to form the shoulder loops 124*a* and 124*b* and the torso loop. In another aspect, the restraining pad 140 can have an inner surface 154 that can have a soft or plush surface to resist marring the optic. In one aspect, the restraining pad 140 can comprise several layers, or can be a laminate, with different layers to provide different functions, such as an outer water-proof layer, an inner plush layer, and/or an intermediate cushion layer or foam layer.

Figure 8A:
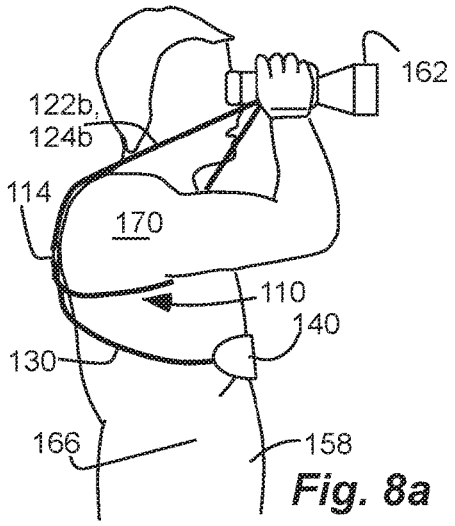
FIG. 8*a* is a schematic side view of the harness of FIG. 7*a*, shown donned by a user and holding the sporting optic at eye level.
Figure 8B:
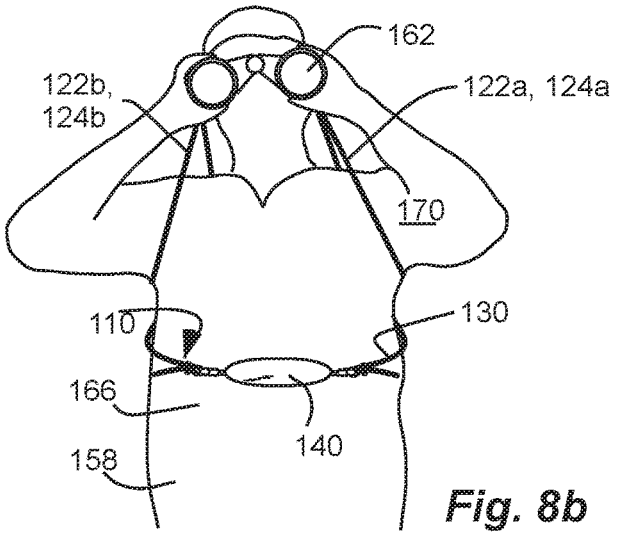
FIG. 8*b* is a schematic front view of the harness of FIG. 7*a*, shown donned by the user and holding the sporting optic at eye level.

FIG. 8*a* depicts a side view of the harness 110 donned by a user 158 and securing the sporting optic 162 held at eye level of the user. Similarly, FIG. 8*b* is a front view of the harness 110 donned by the user 158 and securing the sporting optic 162 held at eye level of the user. The back plate 114 of the harness 110 is disposed at a back of a torso 166 of the user 158. The pair of shoulder straps 122*a* and 122*b* extend from the back plate 114, forming the pair of shoulder loops 124*a* and 124*b* looping around shoulders 170 of the user 158. The pair of shoulder straps 122*a* and 122*b* is sized and/or constructed to allow the sporting optic 162 to be selectively raised to eye level with respect to the user. The torso strap 130 extends from the back plate 14 and wraps around the torso 166 of the user 158 below the pair of shoulder loops 124*a* and 124*b*. The torso strap 130 can be taut about the torso 166 of the user 158. In one aspect, the torso strap 130 is an adjustable belt forming an adjustable loop to wrap taut around the torso 166 of the user 158.

Figure 9A:
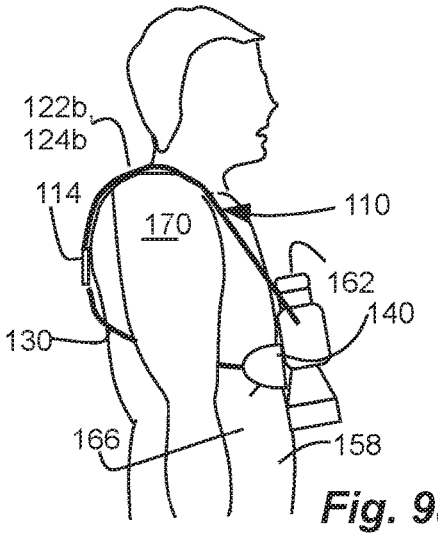
FIG. 9*a* is a schematic side view of the harness of FIG. 7*a*, shown donned by the user and holding the sporting optic at torso level.
Figure 9B:
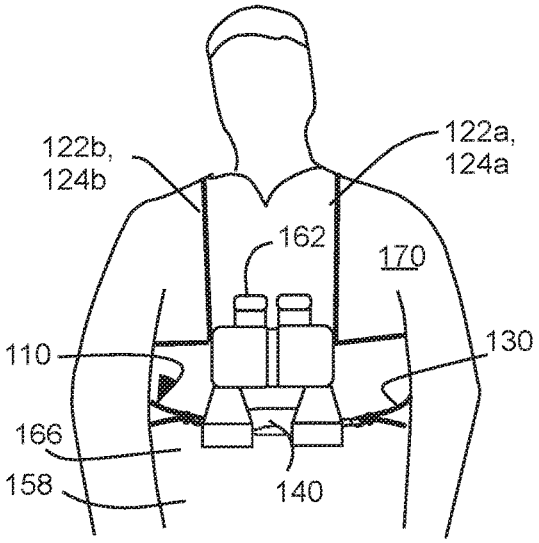
FIG. 9*b* is a schematic front view of the harness of FIG. 7*a*, shown donned by the user and holding the sporting optic at torso level.

FIG. 9*a* depicts a side view of the harness 110 donned by the user 158 and holding the sporting optic 162 at torso level. Similarly, FIG. 9*b* depicts a front view of the harness 110 donned by the user 158 and holding the sporting optic 172 at torso level. The pair of couplers 126*a* and 126*b* secure the sporting optic 162 pendent from the pair of shoulder straps 122*a* and 122*b*. The pair of couplers 126*a* and 126*b* is sized and/or constructed to allow the sporting optic 162 to be selectively lowered to the torso level with respect to the user 158. The restraining pad 140 is coupled to the torso strap 130 and abuts to the sporting optic 162 when the sporting optic is lowered to torso level.

Figure 10A:
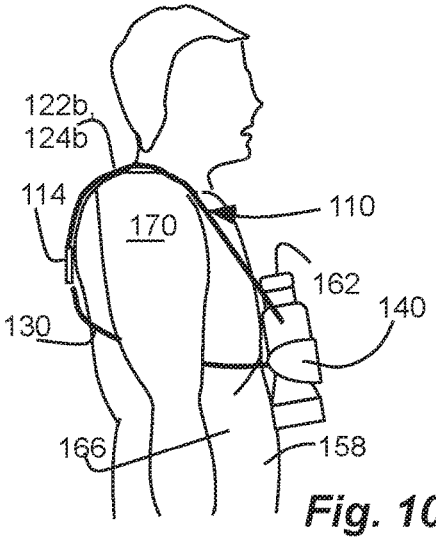
FIG. 10*a* is a schematic side view of the harness of FIG. 7*a*, shown donned by the user and holding the sporting optic at torso level and tucked behind a restraining pad.
Figure 10B:
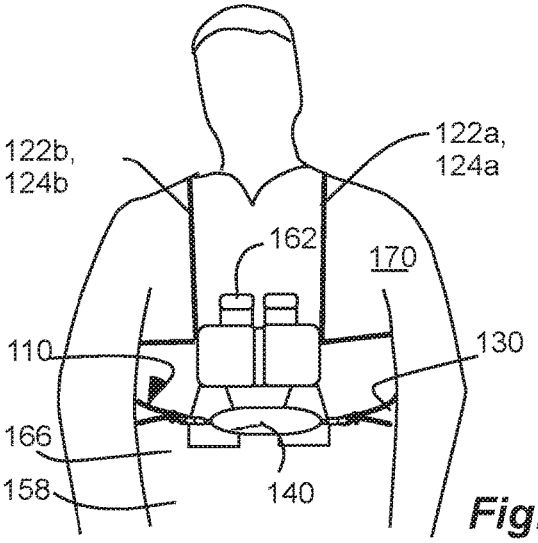
FIG. 10*b* is a schematic front view of the harness of FIG. 7*a*, shown donned by the user and holding the sporting optic at torso level and tucked behind a restraining pad.

FIG. 10*a* depicts a side view of the harness 110 donned by the user 158 and holding the sporting optic 162 at torso level and tucked behind the restraining pad 140. Similarly, FIG. 10*b* depicts a front view of the harness 110 shown donned by the user 158 and holding the sporting optic 162 at torso level and tucked behind the restraining pad 140. The torso strap 130 is sized and positioned with respect to the pair of shoulder straps 122*a* and 122*b* to hold the sporting optic 162 taut against the torso 166 of the user 158 when the sporting optic is lowered to the torso level and tucked behind the restraining pad 140.

Figure 11:
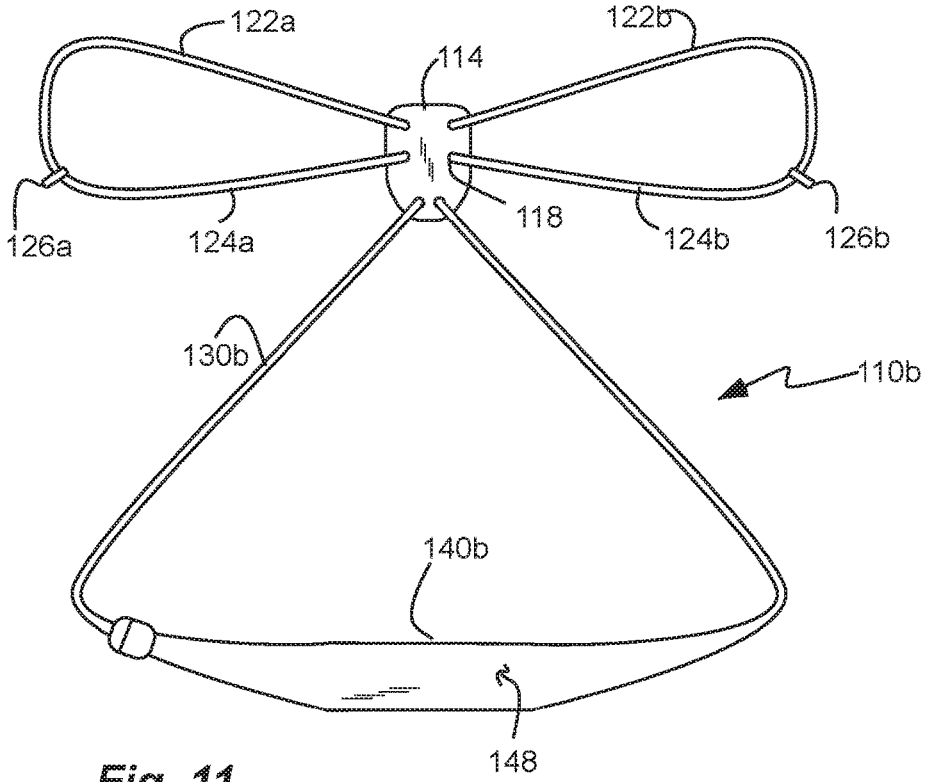
FIG. 11 is a front view of a harness for a sporting optic in accordance with another embodiment of the invention.

FIG. 11 depicts a front view of another harness 110*b* that is similar in many respects to that described above, and which description is hereby incorporated herein by reference. The torso strap 130*b* and the restraining pad 140*b* are integrally formed as a single continuous strap. The single continuous strap can tapper between the torso strap and the restraining pad. The tapper can resist the torso strap and/or the restraining pad from catching on clothing, or surrounding foliage. The torso strap 130*b* can have a buckle to facilitate donning of the harness 110*b*.

Figure 12:
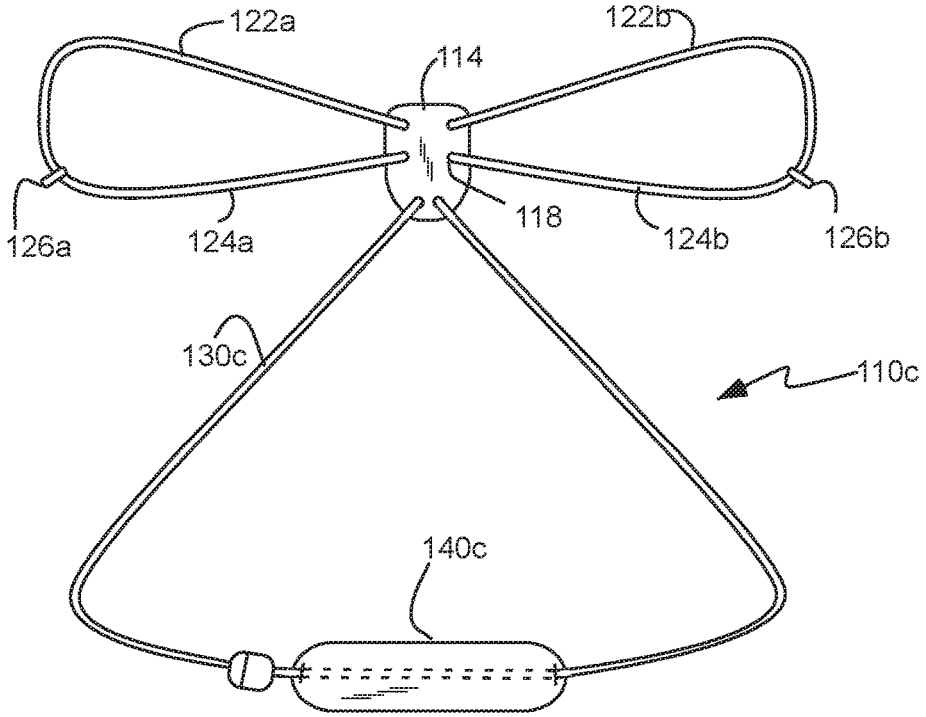
FIG. 12 is a front view of a harness for a sporting optic in accordance with another embodiment of the invention.

FIG. 12 depicts a front view of another harness 110*c* that is similar in many respects to that described above, and which description is hereby incorporated herein by reference. The restraining pad 140*c* can be carried by the torso strap 130*c* with the torso strap extending along the length of the restraining pad, and passing through the restraining pad, or through one or more belt loops of the restraining pad. Thus, the restraining pad 140*c* can be laterally adjusted along a length of the torso strap 130*c*, and with respect to the torso of the user.

A method for securing a sporting optic 162 to a user 158, and for using the harnesses 10 or 10*b* or 10*c* described above, comprises donning the harness 110 or 110*b* or 110*c*, as shown in FIGS. 8*a*-10*b*. Donning the harness can comprise inserting arms through the shoulder straps 122*a* and 122*b*, and wrapping the torso strap 130 or 130*b* or 130*c* around the torso 166. The couplers 144*a* and 144*b* or buckles can be released and coupled to facilitate donning of the torso strap 130 or 130*b* or 130*c*. In one aspect, the torso strap can be taut around the torso of the user due to the elasticity of the torso strap. In another aspect, the torso strap 130 or 130*b* or 130*c* can be adjusted using the drawstring fastener 136 or the buckle.

The sporting optic 162 is secured to the harness 110 or 110*b* or 110*c* with the sporting optic 162 pendent from an upper torso of the user, as shown in FIGS. 9*a* and 9*b*. The sporting optic 162 is secured to the harness 110 or 110*b* or 110*c*, or shoulder straps 122*a* and 122*b* thereof, by the pair of couplers 126*a* and 126*b*, as shown in FIGS. 9*a* and 9*b*.

The sporting optic 162 is selectively raised to eye level while the sporting optic 162 remains secured to the harness 110 or 110*b* or 110*c*, as shown in FIGS. 8*a* and 8*b*. In addition, the sporting optic 162 is selectively lowered to torso level while the sporting optic 162 remains secured to the harness 110 or 110*b* or 110*c* and pendent from the upper torso of the user, as shown in FIGS. 9*a* and 9*b*.

The sporting optic 162 is selectively tucked behind the restraining pad 140 of the torso strap 130 or 130*b* or 130*c*, as shown in FIGS. 10*a* and 10*b*. The torso strap 130 or 130*b* or 130*c* is wrapped taut about the torso 166 of the user 158, and the sporting optic 162 is disposed between the restraining pad 140 of the torso strap 130 or 130*b* or 130*c* and the torso of the user.

In one aspect, the method can further comprises selectively coupling and uncoupling the restraining pad 140 to the torso belt 130.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A harness for a sporting optic, comprising:
a) a pair of shoulder straps forming a pair of shoulder loops configured to loop around shoulders of the user, respectively;
c) a pair of couplers carried by the pair of shoulder straps, respectively, and configured to secure a sporting optic pendent from the pair of shoulder straps;
d) the pair of shoulder straps and/or the pair of couplers being sized and/or constructed to allow the sporting optic to be selectively raised and lowered between eye level and torso level with respect to the user;
e) a torso strap coupled to the pair of shoulder straps and configured to wrap around a torso of the user below the pair of shoulder loops; and
f) a flexible shell coupled to the torso strap and configured to abut to the sporting optic when the sporting optic is lowered to torso level; and
g) the torso strap and the flexible shell being sized and positioned with respect to the pair of shoulder straps to hold the sporting optic taut against the torso of the user when the sporting optic is lowered to the torso level and tucked behind the flexible shell; wherein either:
the pair of shoulder straps and the torso strap are formed by a single continuous strap; or
the harness further comprises:
h) the torso strap having distal free ends;
i) the flexible shell being coupled to and between the distal free ends of the torso strap;
j) a pair of couplers/carabiners/clips disposed on the distal free ends of the torso strap, respectively;
k) a pair of cord locks disposed on the distal free ends of the torso strap, respectively, and capable of selectively receiving the distal free ends of the torso strap therethrough to vary an effective length of the torso strap;
l) the flexible shell having an opening;
m) a pair of tabs coupled to opposite sides of the opening of the flexible shell, respectively;
n) a buckle coupled between the pair of tabs with a first buckle portion coupled to one of the pair of tabs and a second buckle portion coupled to the other of the pair of tabs; and
o) a pair of rings coupled to the pair of tabs, respectively, and being releasably coupled to the pair of couplers/carabiners/clips, respectively, to removably couple the flexible shell to and between the distal free ends of the torso strap.

2. The harness according to claim 1, further comprising:
a) a back plate configured to be disposed at a back of a torso of a user;
b) the pair of shoulder straps extending from the back plate; and
c) the torso strap extending from the back plate.

3. The harness according to claim 1, further comprising:
a) the torso strap having distal free ends;
b) the flexible shell being coupled to and between the distal free ends of the torso strap; and
c) a pair of couplers between the distal free ends of the torso strap and the flexible shell, respectively, to selectively couple and release the flexible shell to the distal free ends of the torso strap.

4. The harness according to claim 1, wherein:
the flexible shell has an expandable and contractible opening.

5. The harness according to claim 1, wherein:
the flexible shell has opening with an elastic band.

6. The harness according to claim 1, wherein:
the flexible shell has a variable and adjustable volume.

7. The harness according to claim 1, further comprising:
a restraining pad having an outer surface; and
indicia disposed on the outer surface of the restraining pad indicative of a surrounding environment or a high visibility warning.

8. A harness for a sporting optic, comprising:
a) a back plate configured to be disposed at a back of a torso of a user;
b) a pair of shoulder straps extending from the back plate and forming a pair of shoulder loops configured to loop around shoulders of the user, respectively;
c) a pair of couplers carried by the pair of shoulder straps, respectively, and configured to secure a sporting optic pendent from the pair of shoulder straps;
d) the pair of shoulder straps and/or the pair of couplers being sized and/or constructed to allow the sporting optic to be selectively raised and lowered between eye level and torso level with respect to the user;
e) a torso strap extending from the back plate and configured to wrap around a torso of the user below the pair of shoulder loops; and
f) a restraining pad coupled to the torso strap and configured to abut to the sporting optic when the sporting optic is lowered to torso level; and
g) the torso strap being sized and positioned with respect to the pair of shoulder straps to hold the sporting optic taut against the torso of the user when the sporting optic is lowered to the torso level and tucked behind the restraining pad;
wherein either:
the pair of shoulder straps and the torso strap are formed by a single continuous strap;
the torso strap and the restraining pad are integrally formed as a single continuous strap; or
the single continuous strap tappers between the torso strap and the restraining pad.

9. The harness according to claim 8, further comprising:

a) the torso strap having distal free ends;

b) the restraining pad being coupled to and between the distal free ends of the torso strap; and c) a pair of couplers between the distal free ends of the torso strap and the restraining pad, respectively, to selectively couple and release the restraining pad to the distal free ends of the torso strap.

10. The harness according to claim 8, wherein:

the restraining pad is wider than the torso strap in a vertical direction with respect to the torso of the user.

11. The harness according to claim 8, wherein:

the torso strap is an adjustable belt forming an adjustable loop configured to wrap taut around the torso of the user.

12. The harness according to claim 8, further comprising:

the restraining pad having an outer surface; and indicia disposed on the outer surface of the restraining pad indicative of a surrounding environment or a high visibility warning.

* * * * *